US005537923A

United States Patent [19]

Boor et al.

[11] Patent Number: 5,537,923

[45] Date of Patent: Jul. 23, 1996

[54] PRINTING SLEEVE AIR PRESSURE MOUNTING APPARATUS

[75] Inventors: Royal E. Boor, Lyons; Richard C. Phillips, Canandaigua; Craig S. Finley, Marion; Stephen D. Burt, Canandaigua, all of N.Y.

[73] Assignee: Huntsman Packaging Corporation, Salt Lake City, Utah

[21] Appl. No.: 449,704

[22] Filed: May 24, 1995

[51] Int. Cl.[6] ..... B41F 13/10

[52] U.S. Cl. ..... 101/375; 492/4; 101/479

[58] Field of Search ..... 101/375, 368, 101/479; 492/4, 45

[56] References Cited

U.S. PATENT DOCUMENTS

| | | | |
|---|---|---|---|
| 4,089,265 | 5/1978 | White et al. | 102/375 |
| 4,383,483 | 5/1983 | Moss | 102/375 |
| 4,386,566 | 6/1983 | Moss | 101/375 |
| 4,407,199 | 10/1983 | Moss | 101/375 |
| 4,624,184 | 11/1986 | Katz et al. | 101/375 |
| 4,651,643 | 3/1987 | Katz et al. | 101/375 |
| 4,685,393 | 8/1987 | Saveressig | 101/375 |
| 4,794,858 | 1/1989 | Katz | 101/375 |
| 5,168,808 | 12/1992 | Prem | 101/479 |
| 5,216,954 | 6/1993 | Thompson | 492/45 |

*Primary Examiner*—Eugene H. Eickholt

*Attorney, Agent, or Firm*—Russell R. Stolle; Ron D. Brown; Neal L. Slifkin

[57] ABSTRACT

An apparatus for facilitating the movement of a printing sleeve with respect to a cylinder is provided which includes a manifold section having an air chamber therein in fluid communication with an air supply line. The manifold section has a plurality of air ports in fluid communication with the air chamber. An adapter ring is provided which surrounds the manifold section and has a plurality of air ports therein, corresponding in number to the air ports in the manifold section and adapted to be placed in fluid communication with the air ports in the manifold section. A locking collar for fixing the position of the manifold section on the shaft in contact with the cylinder and for fixing the adapter ring in contact with the printing sleeve is provided such that when pressurized air is introduced into said supply line, the air exits the air ports in the adapter ring and expands the sleeve thus allowing the sleeve to be moved with respect to the cylinder.

8 Claims, 5 Drawing Sheets

PRINTING SLEEVE AIR PRESSURE MOUNTING APPARATUS

BACKGROUND OF THE INVENTION

1. Field of the Invention

This invention relates in general to an apparatus for facilitating the movement of a printing sleeve with respect to a printing cylinder. More particularly, the invention relates to an improved apparatus for quickly and easily removing a printing sleeve from a cylinder and for quickly and easily installing a printing sleeve on a cylinder.

2. Discussion of the Related Art

In a printing press utilizing rotating printing cylinders, the printing cylinders are placed over shafts. The cylinders vary in outside diameter but have an inside diameter corresponding to the diameter of the shaft. Typically the cylinders are from one to three inches thick. A printing sleeve is mounted on the cylinder by sliding the printing sleeve over the cylinder, and a printing plate is mounted on the printing sleeve. The cylinder and sleeve are connected to a printing press. The printing medium is run past the rotating cylinder such that an image is transferred to the medium. After the press run is complete, the sleeve is removed from the cylinder with the printing plate still attached. The sleeve and plate combination can then be stored and reused the next time the same job is run, saving plate mounting time. To avoid having sleeves slip around the cylinder while printing, the sleeve must fit tightly. This tight fit makes the sleeve difficult to slide on and off the cylinder.

Therefore, it is desirable to have an apparatus for easily and quickly removing the printing sleeve from the cylinder. In the past, to facilitate movement of the sleeve, numerous holes were drilled on the end of the face of the cylinder. Air would be forced into the cylinder and through these holes, creating a cushion of air on the surface of the cylinder. This air cushion would slightly expand the sleeve, which is made from a composite polymeric material, and lubricates the interface between the sleeve and the cylinder so that the sleeve could be easily slid over the cylinder. However, due to the large number of cylinders used in a printing facility, the cost of drilling holes in each cylinder is extremely high.

OBJECTS AND SUMMARY OF THE INVENTION

It is, therefore, an object of the present invention to provide a simple, inexpensive apparatus that permits easy installation and removal of a printing sleeve from a cylinder.

Another object of this invention is to provide an apparatus for the installation and removal of printing sleeves which will work with the entire range of cylinder diameters.

Yet another object of this invention is to provide an apparatus for the installation and removal of printing sleeves which is easy to operate.

Still another object of this invention is to provide an apparatus which will allow for the rapid installation and removal of a printing sleeve.

These and other objects are attained in accordance with the present invention wherein there is provided an apparatus for installation and removal of printing sleeves which overcomes the problems associated with such apparatus of the past.

The apparatus includes a manifold section having an air chamber therein in fluid communication with an air supply line. The manifold section has a plurality of air ports in fluid communication with the air chamber. An adapter ring is provided which surrounds the manifold section and has a plurality of air ports therein, corresponding in number to the air ports in the manifold section and adapted to be placed in fluid communication with the air ports in the manifold section. A means for fixing the position of the manifold section on the shaft in contact with the cylinder and for fixing the adapter ring in proximity to the printing sleeve is provided such that when pressurized air is introduced into said supply line, said air exits said air ports in said adapter ring and expands the sleeve, thus allowing the sleeve to be moved with respect to the cylinder. For example, in the preferred embodiment, an end section and a locking collar are used at the end of the manifold section opposite the cylinder to exert a force on the locking collar to fix the location of the locking collar with respect to the shaft. Preferably, O-rings are provided to seal the manifold against the cylinder and to seal the interface between the manifold and the adapter.

Also provided is a means for exerting force on the manifold section in a direction toward said cylinder. Such means could include, for example, a plurality of lugs which are attached to the body section and, when tightened, exert a force on the manifold section in the direction of the cylinder.

These and other details, advantages and benefits of the present invention will become apparent from the detailed description of the preferred embodiment hereinbelow.

BRIEF DESCRIPTION OF THE DRAWINGS

The preferred embodiment of the invention will now be described, by way of example only, with reference to the accompanying Figures wherein like members bear like reference numerals and wherein.

DETAILED DESCRIPTION OF A PREFERRED EMBODIMENT

Figure 1:
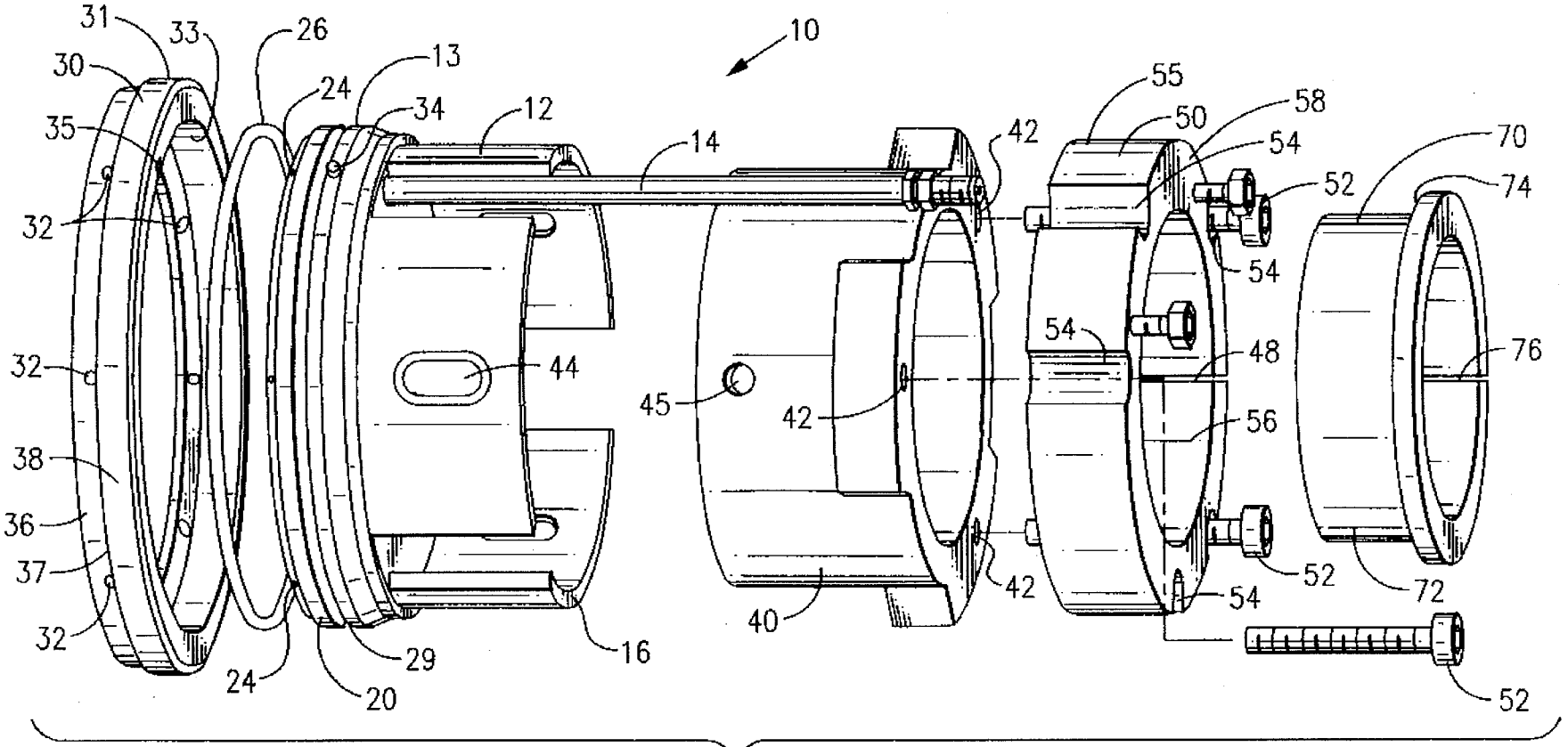
FIG. 1 is an exploded perspective view of the sleeve mounting apparatus constructed according to the present invention.
Figure 2:
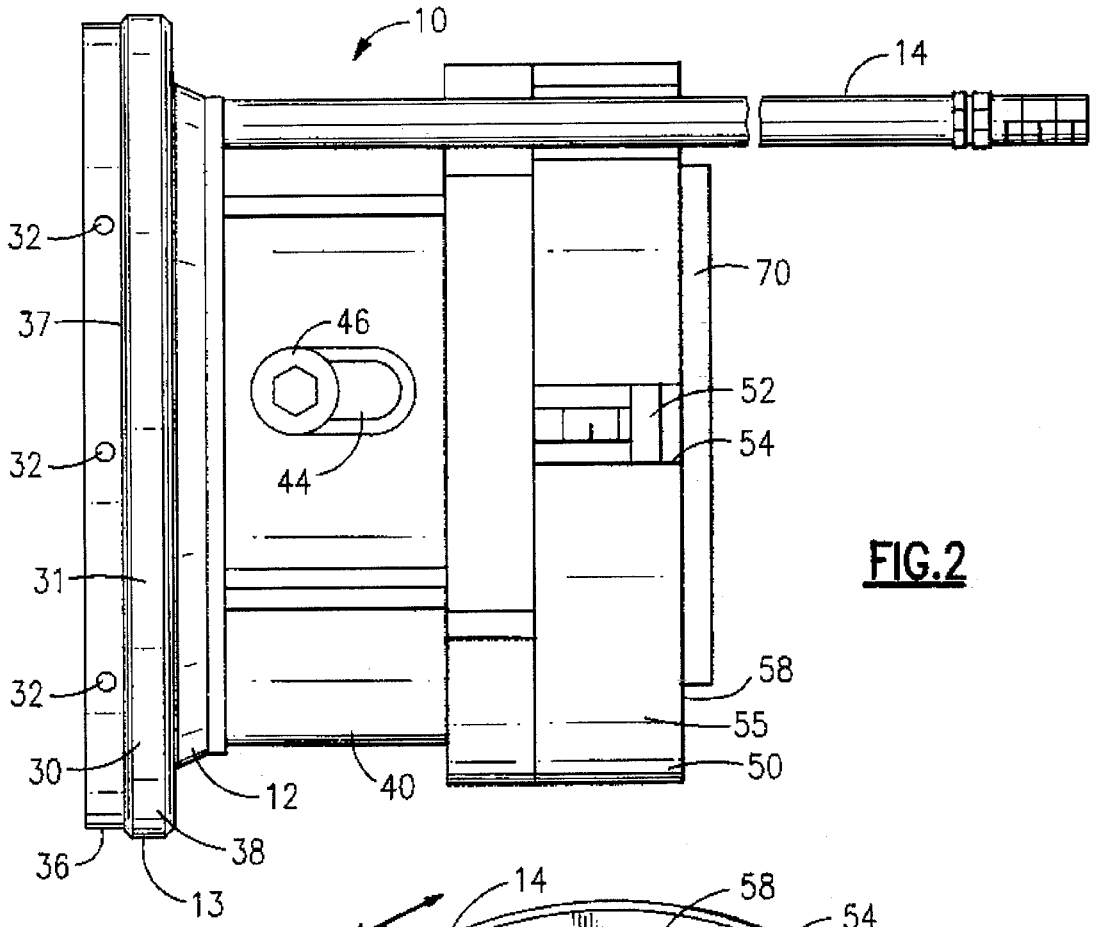
FIG. 2 is a side view of the sleeve mounting apparatus of the present invention.
Figure 3:
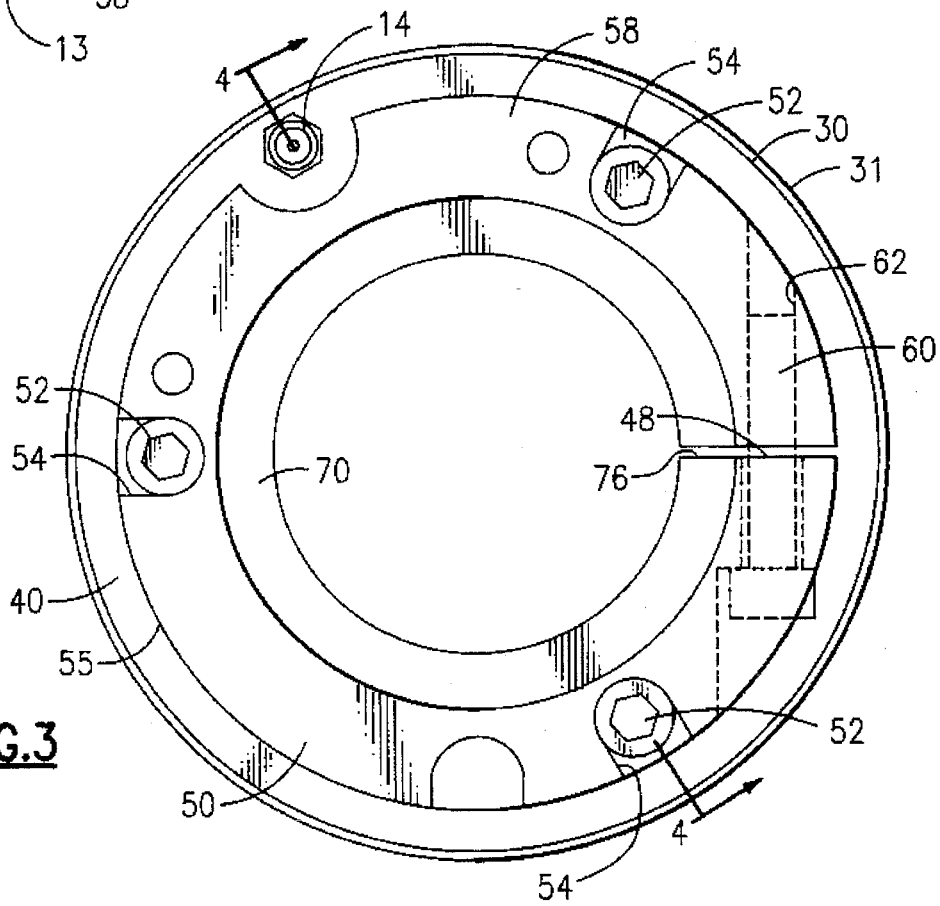
FIG. 3 is an end view of the sleeve mounting apparatus of the present invention.
Figure 4:
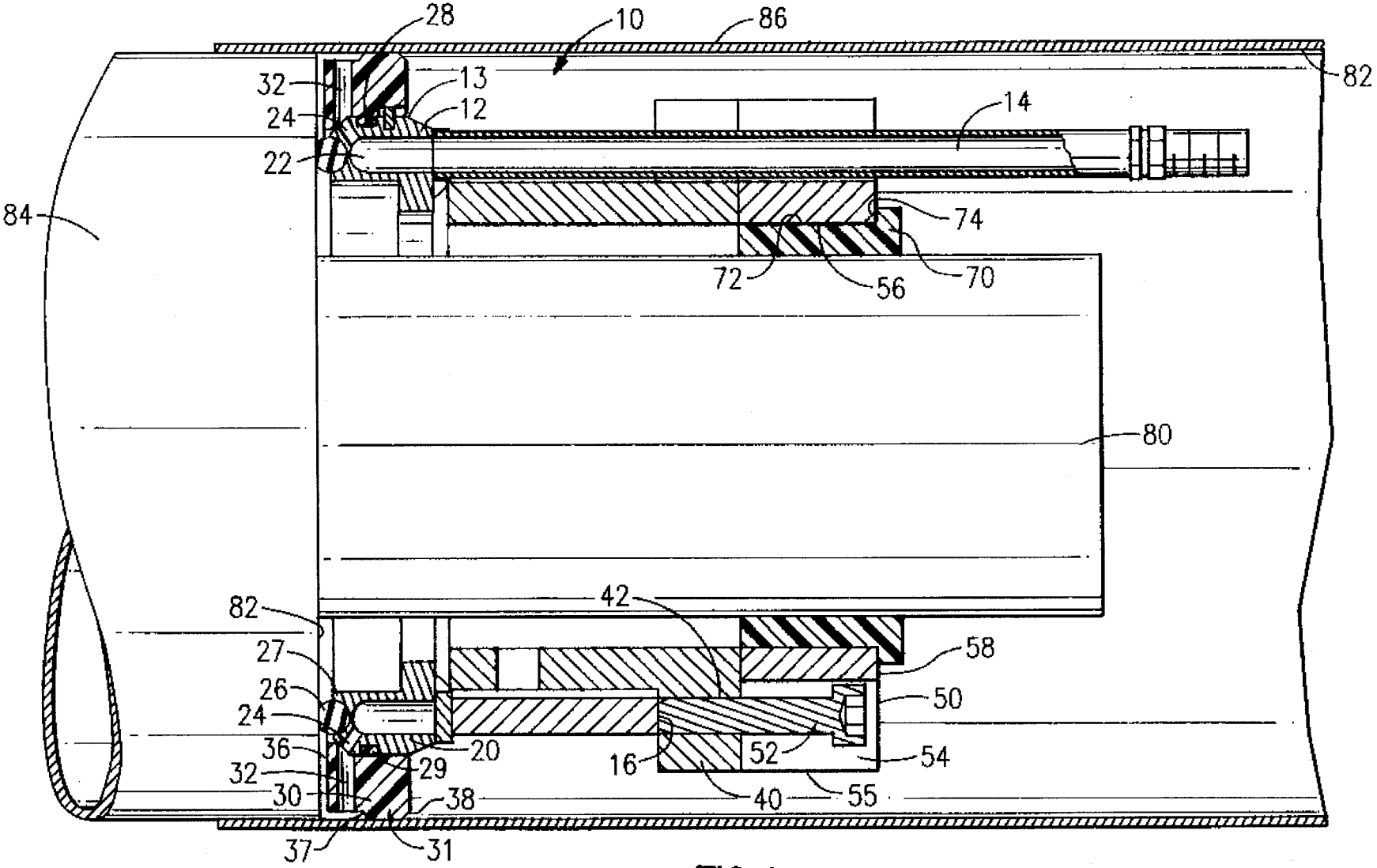
FIG. 4 is a cross-sectional view of the sleeve mounting apparatus of the present invention taken along the line 4—4 in FIG. 3 with the sleeve shown in the uninstalled position.
Figure 5:
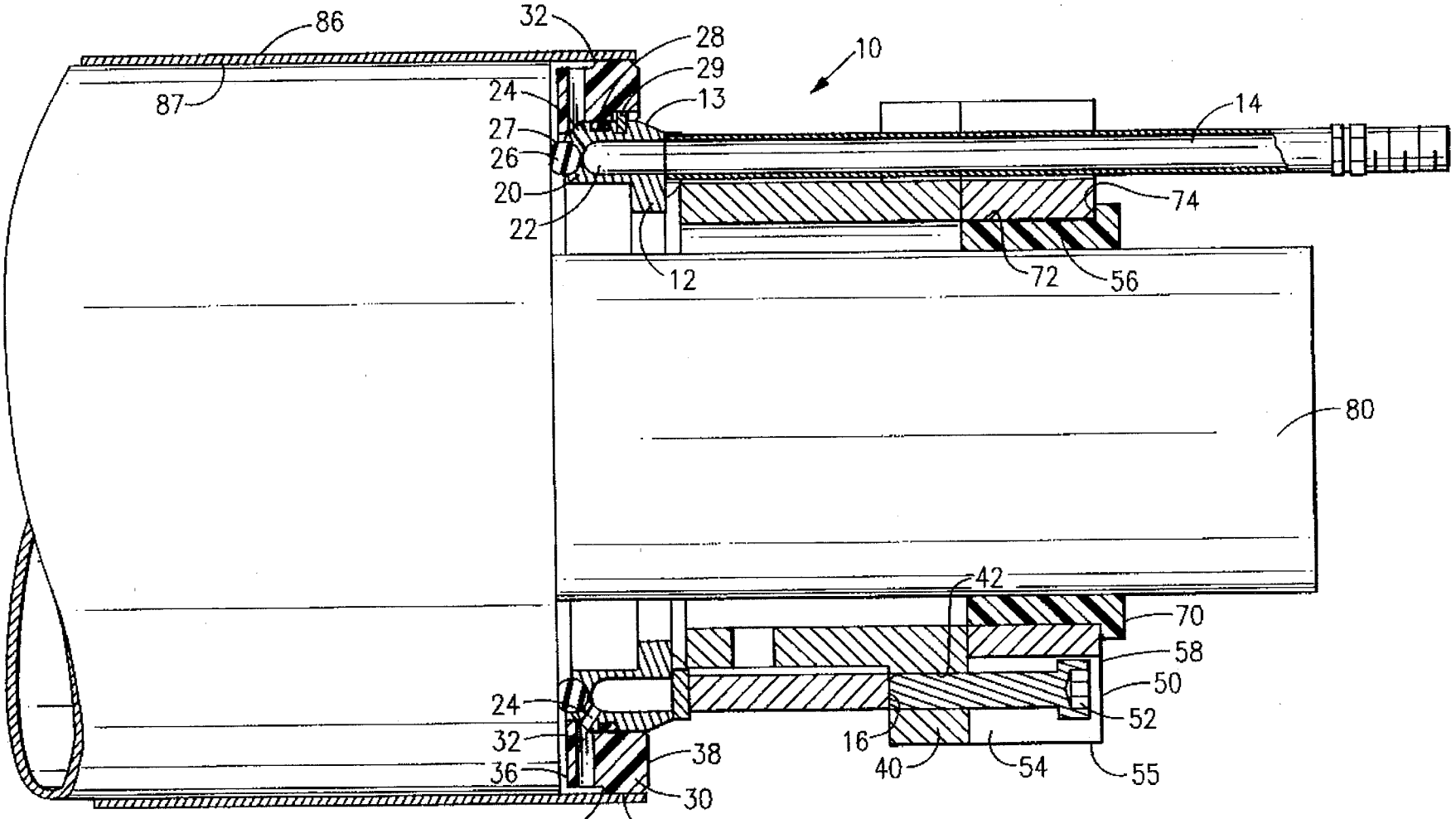
FIG. 5 is a cross-sectional view of the sleeve mounting apparatus of the present invention taken along the line 4—4 in FIG. 3 with the sleeve shown in the installed position.
Figure 7:
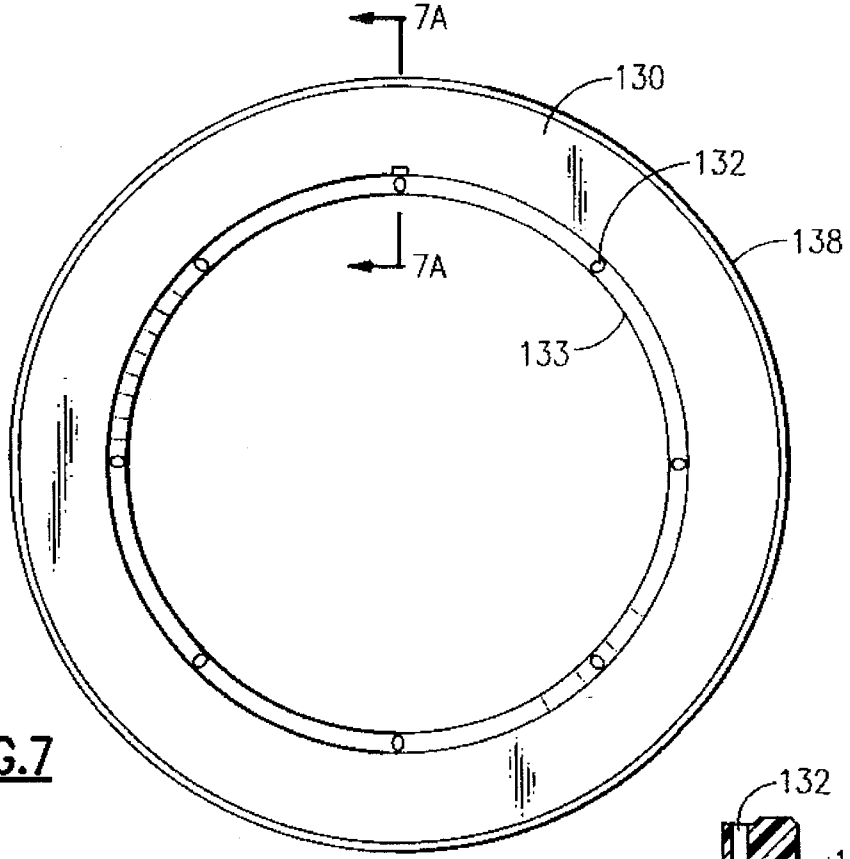
FIG. 7 is an end view of a second adapter ring of the present invention.
Figure 7A:
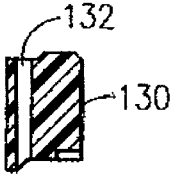
FIG. 7A is a cross-sectional view of the adapter ring of FIG. 7 taken along the line 7A—7A.
Figure 6:
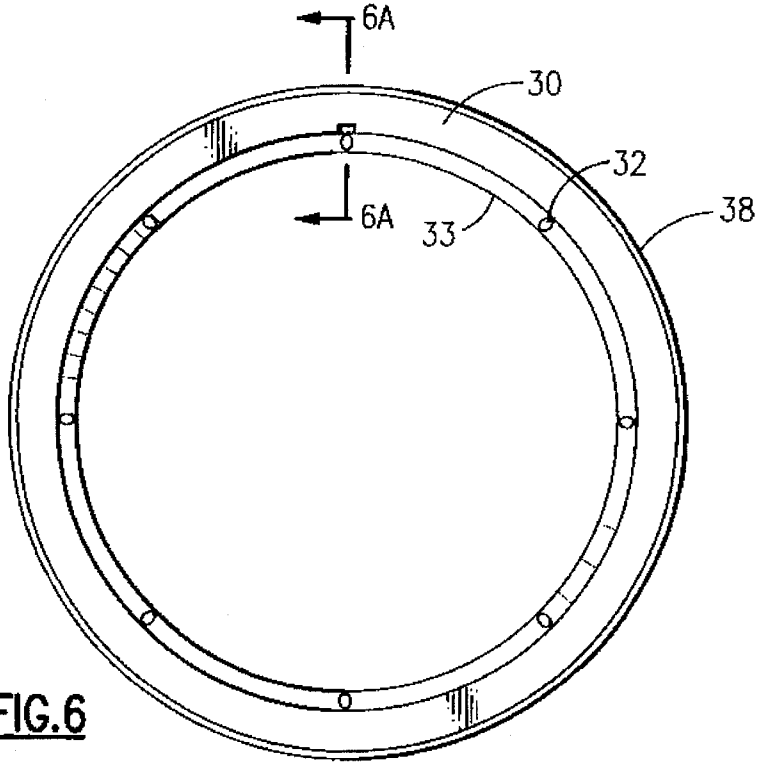
FIG. 6 is an end view of the adapter ring of the present invention.
Figure 6A:
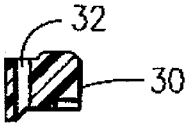
FIG. 6A is a cross-sectional view of the adapter ring of FIG. 6 taken along the line 6A—6A.

Referring now to the drawings, which are for the purpose of illustrating the preferred embodiment of the invention and not for the purpose of limiting the same, FIGS. 1—3 show the sleeve mounting apparatus 10 and FIGS. 4—5 show the sleeve mounting apparatus in connection with a printing therein, corresponding in number to said air ports in said manifold section and adapted to be placed in fluid communication with said air ports in said manifold section, said adapter ring having an outside diameter substantially equal to the outside diameter of the cylinder; and fixing means for fixing the position of said manifold section on the shaft in contact with the cylinder such that when pressurized air is introduced into said supply line, said air exits said air ports in said adapter ring and expands the sleeve thus allowing the sleeve to be moved with respect to the cylinder.

2. The apparatus of claim 1 wherein said fixing means includes an end section and a locking collar at the end of said manifold section opposite the cylinder, said end section adapted to exert a force on said locking collar to fix the location of said locking collar with respect to the shaft.

3. The apparatus of claim 2 further including means associated with said end section for exerting force on said manifold section in a direction toward said cylinder.

4. The apparatus of claim 3 further including means for providing an air tight seal between said manifold section and the cylinder.

5. The apparatus of claim 4 wherein said means for providing an air tight seal between said manifold section and said cylinder includes an O-ring between said manifold section and the cylinder.

6. The apparatus of claim 5 further including means for providing an air tight seal between said manifold section and said adapter ring.

7. The apparatus of claim 6 wherein said means for providing an air tight seal between said manifold section and said adapter ring includes an O-ring.

8. The apparatus of claim 7 wherein said fixing means further includes a body section intermediate said end section and said manifold section and lugs associated with said body section adapted to exert a force on said manifold section in a direction toward the cylinder.

* * * * *